US009671178B2

(12) United States Patent
Zager et al.

(10) Patent No.: US 9,671,178 B2
(45) Date of Patent: Jun. 6, 2017

(54) HEAT EXCHANGER THERMAL FATIGUE STRESS REDUCTION

(71) Applicant: Hamilton Sundstrand Corporation, Windsor Locks, CT (US)

(72) Inventors: Michael Zager, Windsor, CT (US); Donald E. Army, Enfield, CT (US); George Kan, West Hartford, CT (US); Nigel Palmer, West Granby, CT (US); Charles J. McColgan, West Granby, CT (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 666 days.

(21) Appl. No.: 13/963,456

(22) Filed: Aug. 9, 2013

(65) Prior Publication Data

US 2015/0041109 A1 Feb. 12, 2015

(51) Int. Cl.
*F28F 3/00* (2006.01)
*F28D 1/00* (2006.01)
(Continued)

(52) U.S. Cl.
CPC ..... *F28F 3/08* (2013.01); *F28D 1/0366* (2013.01); *F28F 3/025* (2013.01); *F28F 9/001* (2013.01);
(Continued)

(58) Field of Classification Search
CPC ..... F28F 2009/004; F28F 9/001; F28F 9/002; F28F 9/005; F28F 9/0234; F28F 9/026; F28F 9/0263; F28F 9/0265; F28F 9/0268; F28F 9/028; F28F 9/24; F28F 2009/0292; F28F 2009/029; F28F 3/025; F28F 3/046;
(Continued)

(56) References Cited

U.S. PATENT DOCUMENTS 1,409,967 A * 3/1922 Prat ..... F28D 9/0062 165/166
4,099,928 A 7/1978 Norack
(Continued)

FOREIGN PATENT DOCUMENTS

DE 202011052186 U1 3/2013
EP 0117565 A2 9/1984
(Continued)

OTHER PUBLICATIONS

The European Search Report mailed Apr. 2, 2015 for European Application No. 14171812.

*Primary Examiner* — Ryan J Walters
*Assistant Examiner* — Jason Thompson
(74) *Attorney, Agent, or Firm* — Kinney & Lange, P.A.

(57) ABSTRACT

A plate fin heat exchanger includes a plate fin core having a plurality of plates defining a set of hot air passages extending from a hot air inlet region of the plate fin core to a hot air outlet region of the plate fin core and a set of cool air passages extending from a cool air inlet region of the plate fin core to a cool air outlet region of the plate fin core. The plate fin heat exchanger further includes a mounting flange circumscribing the cool air outlet region. At least a portion of the mounting flange has a plurality of heat transfer structures that extend into a flow path of cooling air exiting the cool air outlet region of the plate fin core.

15 Claims, 2 Drawing Sheets

(51) Int. Cl.

| | |
|---|---|
| ***F28F 3/08*** | (2006.01) |
| ***F28F 3/02*** | (2006.01) |
| ***F28F 9/00*** | (2006.01) |
| ***F28D 1/03*** | (2006.01) |
| *F28D 9/00* | (2006.01) |
| *F28F 9/02* | (2006.01) |

(52) U.S. Cl.
CPC ..... *F28F 9/0268* (2013.01); *F28D 9/0062* (2013.01); *F28F 2009/0292* (2013.01)

(58) Field of Classification Search
CPC ..... F28F 3/08; F28D 1/0366; F28D 9/0062; F28D 9/0025; F28D 9/0031; F28D 9/0037; F28D 9/02; F28D 9/0282; F28D 9/0219; F28D 9/00; F28D 2265/14
USPC ..... 165/81, 82, 149, 166
See application file for complete search history.

(56) References Cited

U.S. PATENT DOCUMENTS 5,823,250 A * 10/1998 Barten ..... F01P 11/08 165/140
6,298,908 B1 * 10/2001 Harrell ..... B60H 1/00521 165/69
2002/0036079 A1 * 3/2002 Morel ..... F28D 9/0062 165/166
2006/0201663 A1 * 9/2006 Strahle ..... F28D 9/0031 165/164
2007/0062679 A1 * 3/2007 Agee ..... F28F 9/02 165/158
2011/0168366 A1 * 7/2011 Garret ..... F28D 9/0043 165/148
2012/0291993 A1 * 11/2012 Concialdi ..... F28D 9/0062 165/104.11
2013/0037247 A1 * 2/2013 Baginski ..... F28F 9/028 165/134.1
2013/0140010 A1 * 6/2013 Parfenov ..... F28D 9/00 165/165
2013/0299134 A1 * 11/2013 Deschamps ..... F28F 9/00 165/81

FOREIGN PATENT DOCUMENTS

EP 2551607 A1 1/2013
JP H05248782 A 9/1993

* cited by examiner

HEAT EXCHANGER THERMAL FATIGUE STRESS REDUCTION

BACKGROUND

The present disclosure relates to heat exchangers, and in particular to ram mounting flanges for plate fin heat exchangers.

Heat exchangers are often used to transfer heat between two fluids. For example, in aircraft environmental control systems, heat exchangers may be used to transfer heat between a relatively hot air source (e.g., bleed air from a gas turbine engine) and a relatively cool air source (e.g., ram air). Some heat exchangers, often referred to as plate fin heat exchangers, include a plate fin core having multiple heat transfer sheets arranged in layers to define air passages there between. Closure bars seal alternating inlets of hot air and cool air inlet sides of the core. Accordingly, hot air and cool air are directed through alternating passages to form alternating layers of hot and cool air within the core. Heat is transferred between the hot and cool air via the heat transfer sheets that separate the layers. In addition, to facilitate heat transfer between the layers, each of the passages can include heat transfer fins, often formed of corrugated material (e.g., aluminum), that are oriented in a direction of the flow within the passage. The heat transfer fins increase turbulence and a surface area that is exposed to the airflow, thereby enhancing heat transfer between the layers.

As hot air passes over components of the plate fin heat exchanger (e.g., closure bars, heat transfer fins, and other components), differing thermal expansion properties of the various components can cause the components to expand at different rates. Overall expansion of the core is typically restricted by, for example, housings of the core or other peripheral components of the plate fin heat exchanger. Restricted thermal expansion of the core can cause thermally-induced stress to components of the core, thereby reducing longevity and reliability of the plate fin heat exchanger.

SUMMARY

In one example, a plate fin heat exchanger includes a plate fin core having a plurality of plates defining a set of hot air passages extending from a hot air inlet region of the plate fin core to a hot air outlet region of the plate fin core and a set of cool air passages extending from a cool air inlet region of the plate fin core to a cool air outlet region of the plate fin core. The plate fin heat exchanger further includes a mounting flange circumscribing the cool air outlet region. At least a portion of the mounting flange has a plurality of heat transfer structures that extend into a flow path of cooling air exiting the cool air outlet region of the plate fin core.

In another example, a method includes directing hot air through a set of hot air passages of a core of a plate fin heat exchanger. The set of hot air passages extend in a first direction. The method further includes directing cool air through a set of cool air passages of the core of the plate fin heat exchanger. The set of cool air passages extend in a second direction. The method further includes flowing a portion of the cool air over a plurality of heat transfer structures of a mounting flange that circumscribes a cool air outlet region of the core of the plate fin heat exchanger.

DETAILED DESCRIPTION

According to techniques described herein, a plate fin heat exchanger includes a mounting flange that circumscribes a cool air outlet region of a core of the plate fin heat exchanger. The disclosed flange includes a plurality of heat transfer structures, such as heat transfer fins, that extend into a flow path of cooling air exiting the cool air outlet. In some examples, the heat transfer structures are disposed at a portion of the flange that is proximate a hot-hot region of the plate fin heat exchanger. The hot-hot region is a region of the heat exchanger that is proximate both a hot air inlet region and the cool air outlet region of the plate fin heat exchanger. The plurality of heat transfer structures of the flange transfer heat from the cooling air (which is at its hottest when exiting the cool air outlet) to the mounting flange, thereby causing the mounting flange to expand at a rate that is more similar to a rate of expansion of elements of the core of the heat exchanger. In this way, the disclosed mounting flange helps to decrease thermally-induced stress on components of the heat exchanger, such as those components near the hot-hot region, thereby increasing the longevity of such components.

Figure 1:
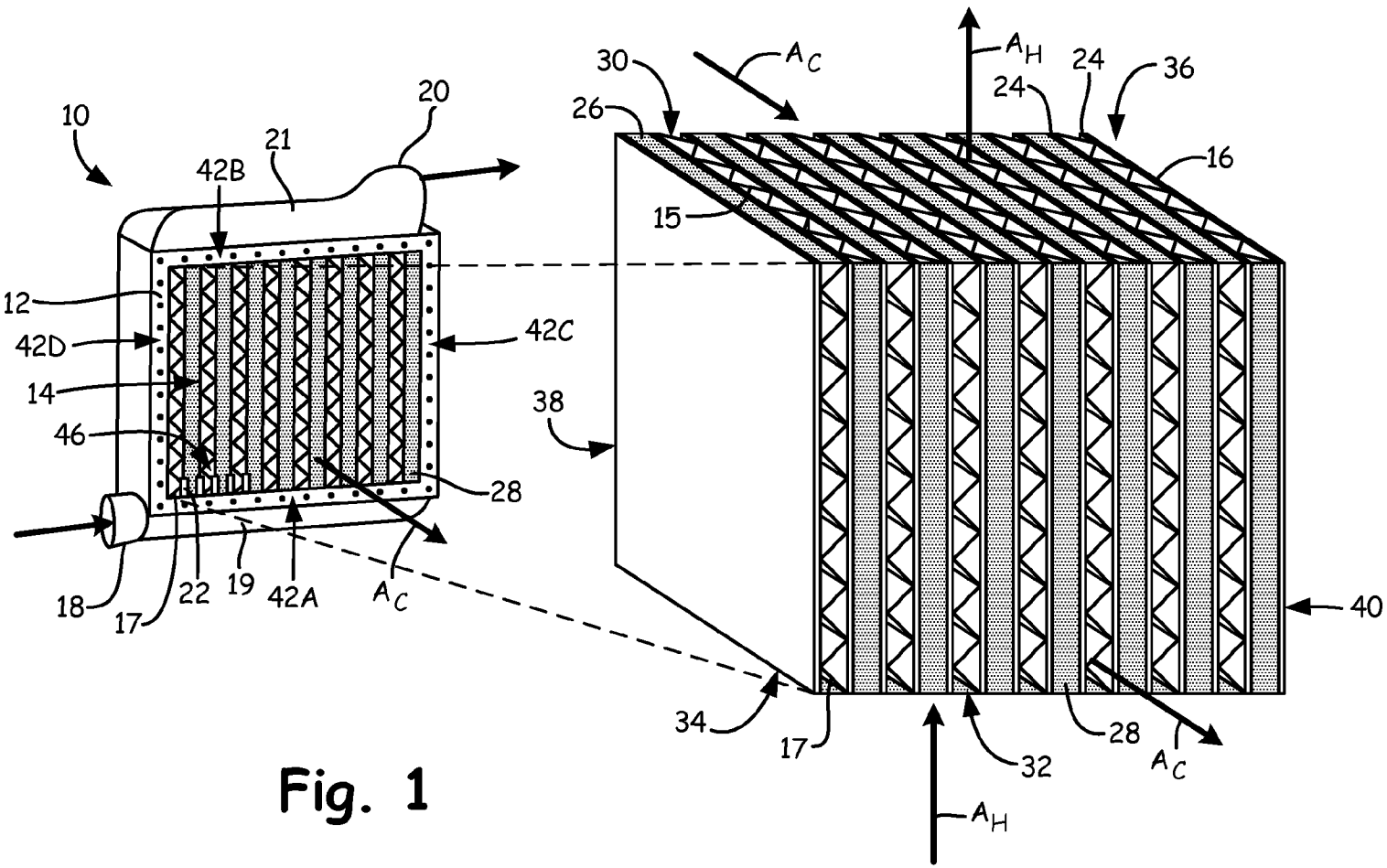
FIG. 1 is a schematic diagram of a plate fin heat exchanger including a mounting flange circumscribing a cool air outlet region of a core of the plate fin heat exchanger.

FIG. 1 is a schematic diagram of plate fin heat exchanger 10 including mounting flange 12 circumscribing cool air outlet region 14 of plate fin core 16, in accordance with one or more aspects of this disclosure. As illustrated, plate fin heat exchanger 10 includes mounting flange 12, plate fin core 16, hot air inlet 18, hot air inlet manifold 19, hot air outlet 20, and hot air outlet manifold 21. Mounting flange 12 includes heat transfer structures 22 (e.g., a plurality of heat transfer structures 22). Plate fin core 16 includes heat transfer plates 24, cool air closure bars 26, and hot air closure bars 28. In some examples, as illustrated in FIG. 1, plate fin core 16 can include hot air fins 15 and cool air fins 17 disposed between heat transfer plates 24 to facilitate heat transfer within plate fin core 16.

Heat transfer plates 24 of plate fin core 16 are arranged in parallel to define a plurality of flow passages there between. As illustrated, heat transfer plates 24 can be generally rectangular plates arranged in parallel layers to define flow passages (e.g., air flow passages) through gaps between the layers. Heat transfer plates 24 can be formed of one or more materials having a relatively high heat transfer coefficient, such as aluminum, copper, silver, gold, or other materials, thereby facilitating efficient heat transfer between air flows through alternating layers.

As in the example of FIG. 1, heat transfer plates 24 can be arranged within plate fin core 16 to define a set of hot air flow passages 30 and a set of cool air flow passages 32. Hot air flow passages 30 extend from hot air inlet side 34 to hot air outlet side 36 of plate fin core 16, thereby defining a hot air inlet region proximate hot air inlet side 34 and a hot air outlet region proximate hot air outlet side 36. As illustrated, hot air outlet side 36 can be arranged opposite hot air inlet side 34. Cool air flow passages 32 extend from cool air inlet side 38 to cool air outlet side 40, thereby defining a cool air inlet region proximate cool air inlet side 38 and a cool air outlet region proximate cool air outlet side 40. As illustrated in FIG. 1, cool air outlet side 40 can be arranged opposite cool air inlet side 38. In some examples, such as the example of FIG. 1, each of cool air inlet side 38 and cool air outlet side 40 can be orthogonal to both of hot air inlet side 34 and hot air outlet side 36, such that plate fin core 16 is generally rectangular in shape.

Plate fin core 16 includes cool air closure bars 26 disposed at hot air inlet side 34 and hot air outlet side 36 of plate fin core 16. As illustrated, cool air closure bars 26 (i.e., a set of cool air closure bars 26) are arranged at hot air outlet side 36 in close physical proximity to the set of cool air flow passages 32 (e.g., by welding, brazing, or other attachment techniques) to seal the set of cool air flow passages 32 against ingress of hot air at hot air outlet side 36. While illustrated as including cool air closure bars 26 arranged at hot air outlet side 36, it should be understood that plate fin core 16 includes similar cool air closure bars 26 disposed at hot air inlet side 34 opposite hot air outlet side 36. That is, each of cool air flow passages 32 is sealed against ingress of hot air at both hot air inlet side 34 and hot air outlet side 36 of plate fin core 16 by a set of cool air closure bars 26. In this way, cool air closure bars 26 are configured to seal cool air flow passages 32 (i.e., a set of alternating flow passages of plate fin core 16) against ingress of hot air, thereby directing hot air received from a hot air source (e.g., engine bleed air from a gas turbine engine, compressed air from an air compressor such as a cabin air compressor, or other hot air sources) into hot air flow passages 30.

Plate fin core 16 further includes hot air closure bars 28 disposed at cool air inlet side 38 and cool air outlet side 40 of plate fin core 16. As illustrated, hot air closure bars 28 are arranged at cool air outlet side 40 in close physical proximity to the set of hot air flow passages 30 (e.g., by welding, brazing, or other attachment techniques) to seal the set of hot air flow passages 30 against ingress of cool air at cool air outlet side 40. While illustrated as including hot air closure bars 28 arranged at cool air outlet side 40, it should be understood that plate fin core 16 includes similar hot air closure bars 28 disposed at cool air inlet side 38 opposite cool air outlet side 40. That is, each of hot air flow passages 30 is sealed against ingress of cool air at both cool air inlet side 38 and cool air outlet side 40 of plate fin core 16 by a set of hot air closure bars 28. In this way, hot air closure bars 28 are configured to seal hot air flow passages 30 (i.e., a set of alternating flow passages of plate fin core 16) against ingress of cool air, thereby directing cool air received from a cool air source (e.g., ram air) into cool air flow passages 32.

As illustrated in FIG. 1, mounting flange 12 can circumscribe cool air outlet region 14. For example, as in the example of FIG. 1, mounting flange 12 can include first leg 42A that extends along an intersection of cool air outlet side 40 and hot air inlet side 34, and second leg 42B that extends along an intersection of cool air outlet side 40 and hot air outlet side 36. In addition, mounting flange 12 can include third leg 42C extending between and orthogonal to first leg 42A and second leg 42B. Fourth leg 42D of mounting flange 12 can be arranged opposite third leg 42C and extending between and orthogonal to first leg 42A and second leg 42B. As such, mounting flange 12 can include four legs arranged about and circumscribing cool air outlet side 40 of plate fin core 16.

According to techniques disclosed herein, at least a portion of mounting flange 12 can include a plurality of heat transfer structures that extend into a flow path of cooling air exiting cool air outlet side 40 of plate fin core 16. For example, as illustrated in FIG. 1, mounting flange 12 can include heat transfer structures 22 that extend from mounting flange 12 into cool air flow path $A_c$ of cooling air traveling through cool air flow passages 32 and exiting cool air outlet side 40 of plate fin core 16. In the example of FIG. 1, heat transfer structures 22 include a plurality of heat transfer fins disposed along first leg 42A of mounting flange 12 proximate hot-hot region 46 of plate fin heat exchanger 10.

Hot-hot region 46 is a region of plate fin heat exchanger 10 that is proximate both hot air inlet 18 and cool air outlet side 40. That is, as cooling air (e.g., ram air) travels from cool air inlet side 38 to cool air outlet side 40 of plate fin core 16, heat transfers from hot air flowing through hot air flow passages 30 to the cooling air flowing through cool air flow passages 32 via heat transfer plates 24 separating the passages. Accordingly, the temperature of the cooling air increases from cool air inlet side 38 to cool air outlet side 40, thereby achieving a maximum temperature of the cooling air proximate cool air outlet side 40. Hot air (e.g., engine bleed air from a gas turbine engine, compressed air from an air compressor such as a cabin air compressor, etc.) is received via hot air inlet 18 and directed toward hot air inlet side 34 of plate fin core 16 by, for example, a hot air manifold. As such, hot-hot region 46, proximate both hot air inlet 18 and cool air outlet side 40, can correspond to a highest temperature of air flowing through plate fin core 16. Accordingly, components of plate fin heat exchanger 10 near hot-hot region 46 (e.g., closure bars, heat transfer plates, heat transfer fins disposed between heat transfer plates, or other components) can be exposed to higher temperature air flow than components that are farther away from hot-hot region 46, thereby causing greater amounts and/or rates of expansion (e.g., volumetric and/or linear expansion) of those components near hot-hot region 46.

Heat transfer structures 22, extending into cool air flow path $A_c$ of cooling air exiting cool air outlet side 40, can transfer heat from the cooling air to mounting flange 12, thereby increasing the rate of expansion of that portion of mounting flange 12. In this way, heat transfer structures 22 can help decrease a difference between a rate of expansion of mounting flange 12 and a rate of expansion of other components of plate fin core 16 (e.g., closure bars, heat transfer fins between heat transfer plates, and the like) that are exposed to air exiting cool air outlet side 40. As such, heat transfer structures 22 can help decrease thermally-induced stress to such components, thereby increasing longevity of the components.

In an example operation of plate fin heat exchanger 10, hot air is received by plate fin heat exchanger 10 via hot air inlet 18 from a hot air source, such as engine bleed air from a gas turbine engine. The hot air received via hot air inlet 18 is directed toward hot air inlet side 34 of plate fin core 16 by hot air inlet manifold 19. Cool air closure bars 26, arranged at hot air inlet side 34 of plate fin core 16, seal cool air flow passages 32 from ingress of the hot air, thereby directing the hot air into hot air flow passages 30 (i.e., an alternating set of air passages of plate fin core 16). Accordingly, hot air flows through hot air flow passages 30 of plate fin core 16 along hot air flow path $A_H$ and exits plate fin core 16 at hot air outlet side 36. Hot air exiting hot air outlet side 36 is collected by hot air outlet manifold 21 and directed toward hot air outlet 20. Cool air is received by plate fin heat exchanger 10 via a cool air inlet from a cool air source, such as ram air accumulated from an aircraft. The cool air is directed toward cool air inlet side 38 of plate fin core 16 by, for example, a cool air manifold. Hot air closure bars 28 seal hot air flow passages 30 from ingress of the cool air, thereby directing the cool air into cool air flow passages 32 (i.e., an alternating set of passages of plate fin core 16 that is complementary to the set of hot air flow passages 30). As such, cool air flows through cool air flow passages 32 of plate fin core 16 along cool air flow path $A_C$ and exits plate fin core 16 at cool air outlet side 40.

In operation, heat transfers between the alternating sets of hot air flow passages 30 and cool air flow passages 32 via heat transfer plates 24 that separate the layers. Hot air fins 15 disposed within hot air flow passages 30, and cool air fins 17 disposed within cool air flow passages 32 enhance heat transfer between the layers. Cooling air increases in temperature as it travels through cool air flow passages 32 from cool air inlet side 38 to cool air outlet side 40. As such, components of plate fin core 16 proximate hot-hot region 46 and exposed to airflow expand at a greater rate than those components farther away from hot-hot region 46 and/or not exposed to airflow. Such expansion can be restricted by mounting flange 12 and other peripheral components, such as a housing of plate fin heat exchanger 10. Heat transfer structures 22, extending from at least a portion of mounting flange 12 (e.g., a portion of mounting flange 12 proximate hot-hot region 46) into cool air flow path $A_C$ can transfer heat from cooling air exiting cool air outlet side 40 to mounting flange 12, thereby increasing a rate of expansion of mounting flange 12 and decreasing thermally-induced stress on components of plate fin core 16 that can result from restricted expansion. In this way, mounting flange 12, including heat transfer structures 22, can increase longevity of components of plate fin core 16.

While mounting flange 12 is illustrated in the example of FIG. 1 as including heat transfer structures 22 along first leg 42A proximate hot-hot region 46, aspects of this disclosure are not so limited. For instance, in certain examples, mounting flange 12 can include heat transfer structures 22 about the entire periphery of mounting flange 12. As another example, mounting flange 12 can include heat transfer structures 22 extending from any portion of any one or more of first leg 42A, second leg 42B, third leg 42C, and fourth leg 42D. In general, mounting flange 12 can include heat transfer structures 22 along any portion of mounting flange 12 to increase a rate of thermal expansion of the portion of mounting flange 12 having heat transfer structures 22.

Figure 2:
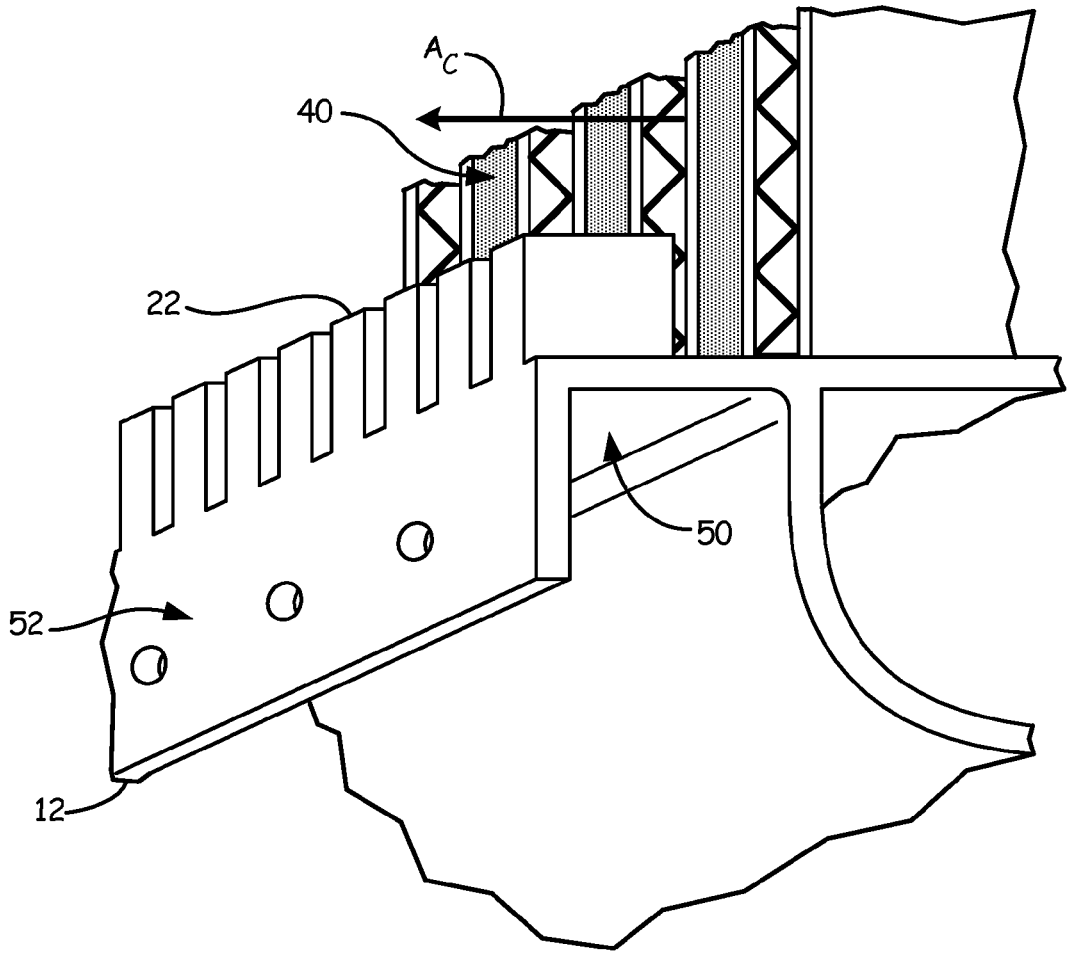
FIG. 2 is a perspective view of a portion of the mounting flange of FIG. 1.

FIG. 2 is a perspective view of a portion of mounting flange 12 of FIG. 1. In particular, FIG. 2 illustrates a portion of mounting flange 12 of FIG. 1 proximate hot-hot region 46 and having heat transfer structures 22 that extend into cool air flow path $A_C$. As illustrated in FIG. 2, mounting flange 12 includes first face 50, second face 52, and heat transfer structures 22. First face 50 is disposed parallel cool air flow path $A_C$ of cooling air exiting cool air outlet side 40. Second face 52 is disposed orthogonal first face 50 and extends in a direction away from cool air flow path $A_C$. In some examples, second face 52 can be configured to mount with at least one external component, such as a cool air manifold to collect cool air exiting cool air outlet side 40.

As illustrated, heat transfer structures 22 extend from first face 50 in a direction toward cool air flow path $A_C$, thereby extending into cool air flow path $A_C$ of cooling air exiting cool air outlet side 40. In some examples, heat transfer structures 22 and mounting flange 12 can be formed of a contiguous piece of material, such as a contiguous piece of aluminum, stainless steel, or other materials. For instance, heat transfer structures 22 can be machined out of mounting flange 12, such that heat transfer structures 22 and mounting flange 12 are formed from a single piece of the same material. In other examples, heat transfer structures 22 can be attached to mounting flange 12, such as by welding, brazing, or other attachment techniques. In such examples, heat transfer structures 22 can be formed of a same or different material than mounting flange 12.

While heat transfer structures 22 are illustrated in the example of FIG. 2 as a plurality of substantially straight heat transfer fins, in other examples, heat transfer structures 22 can have other shapes. For instance, heat transfer structures 22 can include corrugation or other protrusions about one or more faces of heat transfer structures 22. Such protrusions can increase turbulence of airflow past heat transfer structures 22 and/or a surface area of heat transfer structures 22 by which to transfer heat from cooling air exiting cool air outlet side 40. In general, heat transfer structures 22 can be any shape that enables heat transfer structures 22 to transfer heat from cooling air exiting cool air outlet side 40 to mounting flange 12, thereby increasing a rate of thermal expansion of mounting flange 12 and decreasing thermally-induced stress to components of plate fin core 16 that can result from restricted expansion.

The following are non-exclusive descriptions of embodiments of the present disclosure.

A plate fin heat exchanger includes a plate fin core having a plurality of plates defining a set of hot air passages extending from a hot air inlet region of the plate fin core to a hot air outlet region of the plate fin core and a set of cool air passages extending from a cool air inlet region of the plate fin core to a cool air outlet region of the plate fin core. The plate fin heat exchanger further includes a mounting flange circumscribing the cool air outlet region. At least a portion of the mounting flange has a plurality of heat transfer structures that extend into a flow path of cooling air exiting the cool air outlet region of the plate fin core.

The plate fin heat exchanger of the preceding paragraph can optionally include, additionally and/or alternatively, any one or more of the following features, configurations, and/or additional components:

The plurality of heat transfer structures can comprise a plurality of heat transfer fins.

The plate fin heat exchanger can further comprise a hot air inlet proximate the hot air inlet region of the plate fin core. The plurality of heat transfer structures of the mounting flange can be proximate the hot air inlet.

The hot air inlet can be configured to receive at least one of bleed air from a gas turbine engine and compressed air from an air compressor.

The mounting flange and the plurality of heat transfer structures can be formed of a contiguous piece of material.

The material can comprise aluminum.

The hot air inlet region of the plate fin core can be disposed at a first side of the plate fin core. The hot air outlet region of the plate fin core can be disposed at a second side of the plate fin core opposite the first side of the plate fin core.

The cool air inlet region of the plate fin core can be disposed at a third side of the plate fin core that is orthogonal to the first and second sides of the plate fin core. The cool air outlet region of the plate fin core can be disposed at a fourth side of the plate fin core that is opposite the third side and orthogonal to the first and second sides of the plate fin core.

The plurality of heat transfer structures of the mounting flange can be disposed along a leg of the mounting flange that extends along an intersection of the first and fourth sides of the plate fin core.

The mounting flange can comprise a first face disposed parallel the flow path of the cooling air exiting the cool air outlet region of the plate fin core and a second face disposed orthogonal the first face and extending in a direction away from the flow path of the cooling air. The plurality of heat transfer structures can extend from the first face into the flow path of the cooling air exiting the cool air outlet region of the plate fin core.

The second face of the mounting flange can be configured to mount with at least one external component.

The set of hot air passages and the set of cold air passages can comprise alternating sets of passages.

The plate fin heat exchanger can further comprise a cool air inlet proximate the cool air inlet region of the plate fin core.

The cool air inlet can be configured to receive ram air.

A method includes directing hot air through a set of hot air passages of a core of a plate fin heat exchanger. The set of hot air passages extend in a first direction. The method further includes directing cool air through a set of cool air passages of the core of the plate fin heat exchanger. The set of cool air passages extend in a second direction. The method further includes flowing a portion of the cool air over a plurality of heat transfer structures of a mounting flange that circumscribes a cool air outlet region of the core of the plate fin heat exchanger.

The method of the preceding paragraph can optionally include, additionally and/or alternatively, any one or more of the following features, configurations, additional components and/or operations:

The plurality of heat transfer structures can comprise a plurality of heat transfer fins.

Flowing the portion of the cool air over the plurality of heat transfer structures of the mounting flange can comprise flowing the portion of the cool air over the plurality of heat transfer structures of the mounting flange disposed at a hot-hot region of the plate fin heat exchanger.

The hot-hot region of the plate fin heat exchanger can comprise a region of the plate fin heat exchanger that is proximate a hot air inlet region of the plate fin heat exchanger and the cool air outlet region of the plate fin heat exchanger.

The first direction can be orthogonal to the second direction.

Directing the hot air through the set of hot air passages of the core of the plate fin heat exchanger can comprise directing the hot air through a hot air inlet region of the core of the plate fin heat exchanger disposed at a first side of the core of the plate fin heat exchanger, and directing the hot air through a hot air outlet region of the core of the plate fin heat exchanger disposed at a second side of the core of the plate fin heat exchanger. The second side can be opposite the first side.

Directing the cool air through the set of cool air passages of the core of the plate fin heat exchanger can comprise directing the cool air through a cool air inlet region of the core of the plate fin heat exchanger disposed at a third side of the core of the plate fin heat exchanger that is orthogonal to the first and second sides of the core of the plate fin heat exchanger, and directing the cool air through the cool air outlet region of the core of the plate fin heat exchanger. The cool air outlet region can be disposed opposite the third side and orthogonal to the first and second sides of the core of the plate fin heat exchanger.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A plate fin heat exchanger comprising:

a plate fin core having a plurality of plates defining a set of hot air passages extending from a hot air inlet region of the plate fin core to a hot air outlet region of the plate fin core and a set of cool air passages extending from a cool air inlet region of the plate fin core to a cool air outlet region of the plate fin core, wherein the hot air inlet region of the plate fin core is disposed at a first side of the plate fin core, wherein the hot air outlet region of the plate fin core is disposed at a second side of the plate fin core opposite the first side of the plate fin core, wherein the cool air inlet region of the plate fin core is disposed at a third side of the plate fin core that is orthogonal to the first and second sides of the plate fin core, and wherein the cool air outlet region of the plate fin core is disposed at a fourth side of the plate fin core that is opposite the third side and orthogonal to the first and second sides of the plate fin core; and a mounting flange circumscribing the cool air outlet region at the fourth side of the plate fin core the mounting flange defined by first and second parallel legs and third and fourth parallel legs that are perpendicular to the first and second legs, at least a portion of the mounting flange having a plurality of heat transfer structures that extend into a flow path of cooling air exiting the cool air outlet region of the plate fin core, wherein the plurality of heat transfer structures of the mounting flange are comprised on the first leg of the mounting flange which extends along an intersection of the first and fourth sides of the plate fin core.

2. The plate fin heat exchanger of claim 1, wherein the plurality of heat transfer structures comprise a plurality of heat transfer fins.

3. The plate fin heat exchanger of claim 1, further comprising a hot air inlet proximate the hot air inlet region of the plate fin core, wherein the plurality of heat transfer structures of the mounting flange are proximate the hot air inlet.

4. The plate fin heat exchanger of claim 3, wherein the hot air inlet is configured to receive at least one of bleed air from a gas turbine engine and compressed air from an air compressor.

5. The plate fin heat exchanger of claim 1, wherein the mounting flange and the plurality of heat transfer structures are formed of a contiguous piece of material.

6. The plate fin heat exchanger of claim 5, wherein the material comprises aluminum.

7. The plate fin heat exchanger of claim 1, wherein the mounting flange comprises a first face disposed parallel the flow path of the cooling air exiting the cool air outlet region of the plate fin core and a second face disposed orthogonal the first face and extending in a direction away from the flow path of the cooling air, and wherein the plurality of heat transfer structures extend from the first face into the flow path of the cooling air exiting the cool air outlet region of the plate fin core.

8. The plate fin heat exchanger of claim 7, wherein the second face of the mounting flange is configured to mount with at least one external component.

9. The plate fin heat exchanger of claim 1, wherein the set of hot air passages and the set of cold air passages comprise alternating sets of passages.

10. The plate fin heat exchanger of claim 9, wherein the cool air inlet is configured to receive ram air.

11. A method comprising:

directing hot air through a set of hot air passages of a core of a plate fin heat exchanger, the set of hot air passages extending in a first direction, wherein directing the hot air through the set of hot air passages comprises:

directing the hot air through a hot air inlet region of the core of the plate fin heat exchanger disposed at a first side of the core of the plate fin heat exchanger; and directing the hot air through a hot air outlet region of the core of the plate fin heat exchanger disposed at a second side of the core of the plate fin heat exchanger, the second side opposite the first side;

directing cool air through a set of cool air passages of the core of the plate fin heat exchanger, the set of cool air passages extending in a second direction, wherein directing the cool air through the set of cool air passages comprises:

directing the cool air through a cool air inlet region of the core of the plate fin heat exchanger disposed at a third side of the core of the plate fin heat exchanger that is orthogonal to the first and second sides of the core of the plate fin heat exchanger; and directing the cool air through a cool air outlet region of the core of the plate fine heat exchanger that is opposite the third side and orthogonal to the first and second sides; and flowing a portion of the cool air over a plurality of heat transfer structures of a mounting flange that circumscribes the cool air outlet region at the fourth side of the core of the plate fin heat exchanger the mounting flange defined by first and second parallel legs and third and fourth parallel legs that are perpendicular to the first and second legs, wherein the plurality of heat transfer structures of the mounting flange are comprised on the first leg of the mounting flange which extends along an intersection of the first and fourth sides of the plate fin core.

12. The method of claim 11, wherein the plurality of heat transfer structures comprise a plurality of heat transfer fins.

13. The method of claim 11, wherein flowing the portion of the cool air over the plurality of heat transfer structures of the mounting flange comprises flowing the portion of the cool air over the plurality of heat transfer structures of the mounting flange disposed proximate a hot-hot region of the plate fin heat exchanger.

14. The method of claim 13, wherein the hot-hot region of the plate fin heat exchanger comprises a region of the plate fin heat exchanger that is proximate the hot air inlet region of the plate fin heat exchanger and the cool air outlet region of the plate fin heat exchanger.

15. The method of claim 11, wherein the first direction is orthogonal to the second direction.

* * * * *